US005363911A

United States Patent [19]

Velluet et al.

[11] Patent Number: 5,363,911

[45] Date of Patent: Nov. 15, 1994

[54] TWO-PART TUBULAR WALL, AND A METHOD FOR MAKING A MOTOR VEHICLE AIR CONDITIONING CONDENSER HAVING SUCH A TUBULAR WALL

[75] Inventors: Pascal Velluet, Cernay la Ville; Jean-Pierre Tournebize, Aunay Sous Crecy, both of France

[73] Assignee: Valeo Thermique Moteur, Le Mesnil-Saint-Denis, France

[21] Appl. No.: 136,451

[22] Filed: Oct. 14, 1993

[30] Foreign Application Priority Data

Oct. 14, 1992 [FR] France ..... 92 12302

[51] Int. Cl.[5] ..... F28F 9/04

[52] U.S. Cl. ..... 165/173; 165/175; 29/890.052

[58] Field of Search ..... 165/153, 173, 175; 29/890.052, 890.043

[56] References Cited

U.S. PATENT DOCUMENTS

| | | | |
|---|---|---|---|
| 2,583,682 | 1/1952 | Celovsky | 29/890.043 X |
| 5,082,051 | 1/1992 | Ando | 165/173 X |
| 5,107,926 | 4/1992 | Calleson | 165/173 |
| 5,207,738 | 5/1993 | Dey | 165/175 |
| 5,214,847 | 6/1993 | Aoki | 29/890.043 |
| 5,259,449 | 11/1993 | Case | 165/173 |

FOREIGN PATENT DOCUMENTS

| | | |
|---|---|---|
| 0379701 | 8/1990 | European Pat. Off. . |
| 0505243 | 9/1992 | European Pat. Off. . |
| 3803885 | 8/1989 | Germany . |

*Primary Examiner*—John Rivell
*Assistant Examiner*—L. R. Leo
*Attorney, Agent, or Firm*—Morgan & Finnegan

[57] ABSTRACT

A heat exchanger, typically an air conditioning condenser for a motor vehicle, has a fluid header comprising a tubular wall formed with a number of apertures, the heat exchanger having a set of tubes for flow of fluid, with each tube being received sealingly in a respective one of these apertures. The tubular wall comprises two semi-cylindrical wall members assembled together sealingly through their longitudinal edges. Each aperture for receiving a respective tube comprises two slots formed in the respective wall members, extending from an edge of the latter, with lugs being cut out during formation of these slots adjacent to the base of each slot. These lugs are bent outwardly from the fluid header so as to bear on the sides of the tube. During assembly of the heat exchanger, the two wall members are brought towards each other so as to capture the ends of the tubes between them, whereby the tubes penetrate into the slots.

10 Claims, 1 Drawing Sheet

TWO-PART TUBULAR WALL, AND A METHOD FOR MAKING A MOTOR VEHICLE AIR CONDITIONING CONDENSER HAVING SUCH A TUBULAR WALL

FIELD OF THE INVENTION

This invention relates to heat exchangers, and in particular to air conditioning condensers for motor vehicles, of the kind comprising a fluid header in the form of a tubular wall which is formed with apertures elongated transversely to the axis of the tubular wall and aligned with each other along the latter so as to receive a row of fluid flow tubes of the heat exchanger.

The assembly of the flow tubes and the tubular wall together is conventionally carried out by displacing the latter with respect to the set of aligned tubes, in the longitudinal direction of the latter and in such a way as to cause the ends of the tubes to penetrate into the apertures of the tubular wall. If, in an automatic assembly line, the tubular wall is very slightly offset laterally with respect to the row of tubes, or if the latter are not perfectly aligned, the ends of the tubes, or some of them, will not come fully into coincidence with the apertures. This gives rise to damage of the components concerned, and may even cause the assembly operation to be interrupted.

DISCUSSION OF THE INVENTION

An object of the invention is to overcome the above mentioned drawback.

To this end, according to the invention in a first aspect, a tubular wall for a fluid header for a heat exchanger, having apertures elongated transversely to its axis and aligned mutually along the latter so as to receive fluid flow tubes having an elongated transverse cross section, is characterised in that it comprises two wall members assembled sealingly together against leakage of the said fluid, with each said wall member extending over part of the circumference of the tubular wall, and in that lugs, which are cut out in the wall so as to define the said apertures, are bent back substantially in the same direction as the longitudinal axis of the tubes at the two respective ends of each aperture.

The lugs may be oriented either outwardly or inwardly.

According to a preferred feature of the invention, in one embodiment thereof, the apertures and the lugs are formed in only one of the two wall members.

Preferably, the two lugs of each aperture are then slightly divergent with respect to each other outwardly of the wall, in order to ensure that the corresponding tube is properly centred in the aperture in the tubular wall during assembly with the latter.

In another preferred embodiment of the invention, each said aperture is defined by two slots, formed respectively in the two said wall members, with the two said lugs associated with any one of these apertures being part of a respective one of the two wall members. The two lugs of each aperture may then be substantially parallel to each other. In this second embodiment, assembly may be carried out by moving each of the components of the tubular wall at right angles to the longitudinal direction of the tubes.

According to the invention in a second aspect, there is provided a method of making a heat exchanger comprising a tubular wall according to the said first aspect of the invention, together with a row of fluid flow tubes having an elongated transverse cross section and being engaged in the apertures of the tubular wall, wherein the said method comprises displacing each of the two wall members constituting the tubular wall, with respect to the row of tubes and in the longitudinal direction of the right cross section of the latter, the two wall members being displaced towards each other on either side of the ends of the tubes, which penetrate into the slots in the wall members until the lugs come into engagement on the tubes; and the two wall members are secured together sealingly thereafter.

According to a preferred feature of the said method, at least one disc is positioned on one of the two said wall members so as to constitute a transverse bulkhead of the fluid header, the peripheral edge of the said disc making contact with the concave internal surface of the second wall member at the conclusion of the relative movement between the two wall members, being subsequently secured sealingly to the latter.

Further features and advantages of the present invention will appear more clearly on a reading of the detailed description of a preferred embodiment of the invention which follows, and which is given by way of example only and with reference to the accompanying drawings.

DESCRIPTION OF A PREFERRED EMBODIMENT OF THE INVENTION

Figure 1:
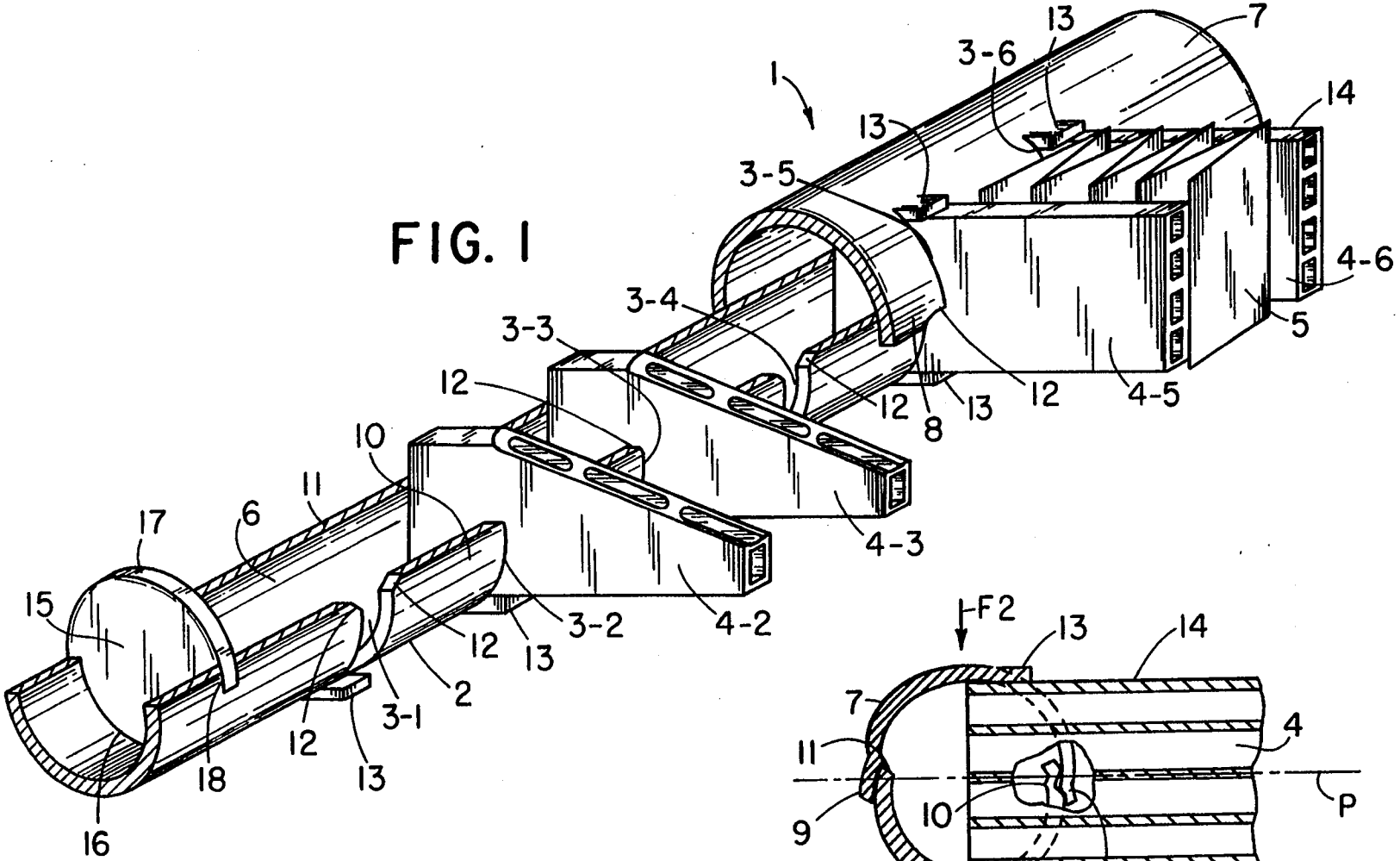
FIG. 1 is a partly cut away perspective view showing part of a condenser in accordance with the invention.

FIG. 1 shows, by way of example, a fluid header 1 having a tubular wall 2 which is formed with six apertures 3-1 to 3-6, for receiving an equal number of tubes for fluid flow. Only four of these tubes are shown, these being shown only partially so that the tubular wall can be seen more clearly in the drawings. The tubes concerned are indicated by the reference numerals 4-2, 4-3, 4-5 and 4-6. A spacer 5, consisting of a strip of metallic sheet (which is bent into a zigzag shape or curved to the shape of a sine wave) placed between the tubes 4-5 and 4-6 and in thermal contact with these latter. Such spacers are associated with each consecutive pair of tubes of the condenser.

The tubular wall 2 consists of two substantially semi-cylindrical members 6 and 7, the member 7 being shown partially cut away so that the other member 6 can be clearly seen. The longitudinal marginal zones 8 and 9 (FIG. 2) of the member 7 overlie the longitudinal marginal zones 10 and 11 respectively of the member 7 externally. The marginal zones 8 and 10, and the marginal zones 9 and 11, are assembled sealingly together so as to prevent escape of the fluid flowing in the condenser. These marginal zones are secured together for example by brazing.

Each of the apertures 3 is in the form of a slot formed in the wall member 6, extending from the marginal zone 10 of the latter, and by another slot which is formed in a similar way in the other wall member 7, extending from its marginal zone 8. The two sides of each of these slots are joined to the corresponding edge of the wall member concerned through a chamfer 12. Instead of completely eliminating the material which is cut out from the wall members 6 and 7 in the formation of these slots, a small part of this material is left so as to constitute a lug 13 attached to the remaining part of the respective wall member 6 or 7 at the base of each slot. Each of these lugs extends towards the outside of the header parallel to the longitudinal direction of the tubes. The two lugs 13 associated with any one of the apertures 3 are in engagement respectively on the two small longitudinal sides 14 of the corresponding tube 4, that is to say with the ends of the elongated transverse cross section of the tube.

Figure 2:
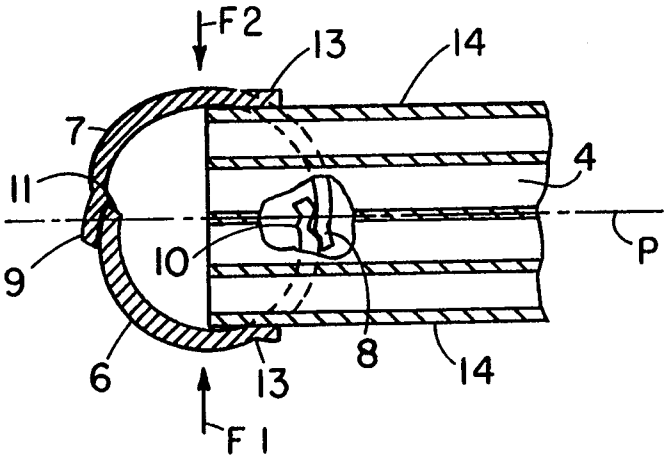
FIG. 2 is a view in cross section showing part of the condenser shown in FIG. 1, the cross section being taken on the longitudinal mid-plane of a tube.

It will be seen that, in order to assemble the tubular wall 2 and the tubes 4 together, all that is necessary is to offer up the wall members 6 and 7 towards each other, and to offer each of these members up to the row of tubes in the direction of the arrows F1 and F2 respectively in FIG. 2, that is to say in the longitudinal direction of the right cross section of the tubes. Each tube then penetrates into two slots of the two respective wall members, with the chamfers 12 providing any necessary centring of the tubes in the slots and thereby facilitating their introduction. The relative displacement of the components is continued until the lugs 13 come into engagement on the sides 14 of the tubes. The marginal zones 8 and 10, 9 and 11 of the wall members 6 and 7 are then secured sealingly together, and the tubes are secured sealingly to the tubular wall 2 itself.

FIG. 1 also shows a transverse bulkhead 15 which limits the fluid header 1 at one longitudinal end of the latter. A further similar bulkhead (not shown) is arranged at the other end of the header. The bulkhead 15 consists of a disc, with one portion 16 of its peripheral edge being in sealing contact with the internal surface of the wall member 6, while another portion 17 of the peripheral edge of the bulkhead is in sealing contact with the internal surface of the other wall member 7. At least one marginal region of the disc 15, limited in the circumferential direction, is accommodated in apertures or slots 18 formed through the thickness of the wall member 6, in such a way as to enable the disc 15 to be positioned with respect to the wall member 6 during assembly. During the relative displacement of the wall members 6 and 7 described above, the portion 7 of the peripheral edge of the disc 15 is brought towards the internal surface of the wall member 7, and comes into contact with the latter at the end of this displacement. Sealing at this point can also be obtained for example by brazing, with sealing attachment between the disc 15 and the wall member 6 being carried out at the same time, during the operation of brazing the various components together.

What is claimed is:

1. A heat exchanger fluid header having a tubular wall defining an axis thereof and a plurality of apertures in the tubular wall, each said aperture being elongated transversely to the said axis and the apertures being aligned with each other along the tubular wall, together with a plurality of fluid flow tubes of elongate transverse cross section, each tube being received in a respective said aperture, wherein the tubular wall comprises a first wall member and a second wall member assembled together sealingly against escape of fluid from within the tubular wall, with each said wall member extending over part of the circumference of the tubular wall, each said tube defining a longitudinal tube axis, and each said aperture being cut from the tubular wall so as to define bent lugs at the two respective ends of each said aperture, said lugs extending substantially parallel to the longitudinal axis of the corresponding said tube.

2. A heat exchanger fluid header according to claim 1, wherein the said lugs are oriented outwardly.

3. A heat exchanger fluid header according to claim 1, wherein the said lugs are oriented inwardly.

4. A heat exchanger fluid header according to claim 1, wherein only one of the said wall portions defines all the said apertures and lugs.

5. A heat exchanger fluid header according to claim 4, wherein the two said lugs of each aperture are slightly divergent with respect to each other, towards the outside of the tubular wall.

6. A heat exchanger fluid header according to claim 1, wherein each said wall member defines a plurality of slots, each open at one end, each slot in the first wall member being aligned with a corresponding said slot in the second wall member so as to define together a respective said aperture, with the two lugs of any one aperture being part of the respective wall members.

7. A heat exchanger fluid header according to claim 6, wherein the two lugs of each aperture are substantially parallel to each other.

8. A heat exchanger fluid header according to claim 6, wherein each said slot has an open end defining chamfers widening its said open end.

9. A method of making a heat exchanger having a fluid header according to claim 6 and further comprising a row of fluid flow tubes having an elongate transverse cross section, with each said tube being engaged in a respective said aperture of the tubular wall, the said method including the steps of: displacing each of the two said wall members with respect to the row of tubes in the longitudinal direction of the right cross section of the latter, the two wall members being displaced towards each other on either side of the ends of the tubes so that the latter enter into the said slots in the wall members until the said lugs of the latter come into engagement on the tubes; and securing the two wall members sealingly together.

10. A method according to claim 9, further including the step of locating at least one disc, constituting a transverse bulkhead of the fluid header, on one of the wall members, with the peripheral edge of the said disc making contact with the concave internal surface of the second wall member at the conclusion of the relative movement of the two wall members; and subsequently securing the said at least one disc sealingly to the wall members.

* * * * *